US006008707A

United States Patent [19]

Tada et al.

[11] Patent Number: 6,008,707

[45] **Date of Patent: *Dec. 28, 1999**

[54] ANTENNA DUPLEXER

[75] Inventors: Hitoshi Tada; Hideyuki Kato, both of Kyoto, Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/710,665

[22] Filed: Sep. 26, 1996

Related U.S. Application Data

[63] Continuation of application No. 08/340,542, Nov. 16, 1994, Pat. No. 5,686,873.

[30] Foreign Application Priority Data

Nov. 18, 1993 [JP] Japan ..... 5-289400

[51] Int. Cl.[6] ..... H01P 1/213

[52] U.S. Cl. ..... 333/134; 333/202; 333/206

[58] Field of Search ..... 333/202, 206, 333/207, 126, 129, 134, 222

[56] References Cited

U.S. PATENT DOCUMENTS

| | | | |
|---|---|---|---|
| 4,742,562 | 5/1988 | Kommrusch | 333/134 X |
| 5,103,197 | 4/1992 | Turunen et al. | 333/134 X |
| 5,146,193 | 9/1992 | Sokola | 333/206 |
| 5,208,565 | 5/1993 | Sogo et al. | 333/206 |
| 5,216,394 | 6/1993 | Konishi et al. | 333/222 |
| 5,239,279 | 8/1993 | Turunen et al. | 333/134 |
| 5,241,693 | 8/1993 | Kim et al. | 333/206 X |
| 5,250,916 | 10/1993 | Zakman | 333/206 |
| 5,323,127 | 6/1994 | Komazaki et al. | 333/202 X |
| 5,379,011 | 1/1995 | Sokola et al. | 333/134 X |
| 5,537,082 | 7/1996 | Tada et al. | 333/202 |
| 5,546,059 | 8/1996 | Yorita et al. | 333/206 X |
| 5,572,174 | 11/1996 | Kitaichi et al. | 333/206 |
| 5,629,656 | 5/1997 | Tada et al. | 333/206 X |
| 5,642,084 | 6/1997 | Matsumoto et al. | 333/206 X |
| 5,686,873 | 11/1997 | Tada et al. | 333/206 X |

FOREIGN PATENT DOCUMENTS

| | | | |
|---|---|---|---|
| 0508734A1 | 10/1992 | European Pat. Off. . | |
| 538894 | 4/1993 | European Pat. Off. | 333/202 DB |
| 217701 | 9/1987 | Japan | 333/202 DB |
| 0069102 | 3/1989 | Japan | 333/202 |
| 4-103203 | 4/1992 | Japan | 333/202 |
| 6132706 | 5/1994 | Japan | 333/202 DB |
| 6303008 | 10/1994 | Japan | 333/206 |
| 5-145302 | 6/1996 | Japan | 333/206 |
| 225047 | 6/1994 | Taiwan . | |

OTHER PUBLICATIONS

Patent Abstracts of Japan; vol. 12, No. 9 (E–572) Jan. 12, 1988; JP–A–62169503 (TDK Corp.); Jul. 25. 1987.

Patent Abstracts of Japan; vol. 10, No. 367 (E–462) (2424); Dec. 9, 1986; JP–A–61161806 (Mitsubushi Electric Corp.); Jul. 22, 1986.

Patent Abstracts of Japan; vol. 6, No. 151 (E–124) (1029); Aug. 11, 1982; JP–A–57073501 (Fujitsu K.K); May 8, 1982.

*Primary Examiner*—Seungsook Ham

*Attorney, Agent, or Firm*—Ostrolenk, Faber, Gerb & Soffen, LLP

[57] ABSTRACT

Resonator holes are formed extending one to the other of a pair of opposing end surfaces of a dielectric block, and inner conductors are formed on inner peripheral surfaces of resonator holes respectively. On an outer surface of dielectric block, a pair of input/output electrodes and one antenna electrode are formed, and expect these regions, an outer conductor is formed. By the coupling of two resonators corresponding to the resonator holes, a transmitting filter is provided, and by two resonators corresponding to resonator holes, a receiving filter is formed.

11 Claims, 3 Drawing Sheets

ANTENNA DUPLEXER

This is a continuation of application Ser. No. 08/340,542, filed Nov. 16, 1994, now U.S. Pat. No. 5,686,873.

BACKGROUND OF THE INVENTION

1. Field of the Invention

The present invention relates to an antenna duplexer. More specifically, the present invention relates to an antenna duplexer used for mobile communication equipment, such as automobile telephones and portable telephones.

2. Description of the Background Art

FIG. 1 is an equivalent circuit diagram of an antenna duplexer serving as an antenna both for a transmitter and for a receiver. Referring to FIG. 1, the antenna duplexer includes three terminals for input and output, which are designated as transmitting terminal TX, receiving terminal RX and antenna terminal ANT. Resonators R1 and R2 are for the transmitter, and resonators R3 and R4 are for the receiver. Each of these resonators is connected to ground. Also, resonator R1 is connected to transmitting terminal TX through an external coupling capacitance Ce1, resonator R2 is connected to antenna terminal ANT through external coupling capacitance Ce2, resonator R3 is connected to antenna terminal ANT through external coupling capacitance Ce3, and resonator R4 is connected to receiving terminal RX through an external coupling capacitance Ce4.

FIG. 2 is a perspective view showing a specific example of the antenna duplexer schematically shown in FIG. 1. Referring to FIG. 2, the antenna duplexer includes two dielectric filters 1*a* and 1*b*, and a coupling board 20. Each of the dielectric filters 1*a* and 1*b* consists of two stages of resonators. More specifically, dielectric filter 1*a* includes an approximately rectangular dielectric block 10*a* which includes two resonator holes 21*a* and 22*a* extending from an apertured surface 11*a* to an opposite surface 12*a*. Also, inner conductors 31*a* and 32*a* are formed on inner peripheral surfaces of resonator holes 21*a* and 22*a*, respectively.

A pair of input/output electrodes 51*a* and 52*a* are formed at opposite corner portions of dielectric block 1*a*, and extend from a side surface to the bottom surface of dielectric block 1*a*. On the outer peripheral surface except the regions on which input/output electrodes 51*a* and 52*a* are formed, an outer conductor 4*a* is provided. The inner conductors 31*a* and 32*a* are not provided at end portions of resonator holes 21*a* and 22*a* on the side of the apertured surface (hereinafter referred to as "open end surface") 11*a*. Therefore on open end surface 11*a*, inner conductors 31*a* and 32*a* are isolated from external conductor 4*a*, i.e., not electrically conducted. On the other surface (hereinafter referred to as "short-circuited surface") 12*a* opposite to the open end surface 11*a*, the resonator holes 21*a* and 22*a* are electrically conducted to with the external conductor 4*a* (short-circuited).

The other dielectric filter 1*b* is formed similarly as the above described dielectric filter 1*a*. Namely, it includes a dielectric block 10*b*, resonator holes 21*b* and 22*b*, inner conductors 31*b* and 32*b*, an outer conductor 4*b*, input and output electrodes 51*b* and 52*b*, an open end surface 11*b* and a short-circuited end surface 12*b*.

The coupling board 20 is for coupling two dielectric filters 1*a* and 1*b* placed parallel to each other, and it includes input/output electrodes 201 and 202 and an antenna electrode 203 formed on the surface thereof. Input/output electrode 201 corresponds to the input/output electrode 51*a* of dielectric filter 1*a*, input/output electrode 202 corresponds to the input/output electrode 52*b* of the dielectric filter 1*b*, and antenna electrode 203 corresponds to input/output electrodes 52*a* and 51*b* of the dielectric filters 1*a* and 1*b*, respectively. On the entire surface of coupling board 20, except the regions where input/output electrodes 201, 202 and antenna electrode 203 are formed, a ground conductor 204 is formed.

The dielectric filters 1*a* and 1*b*, as described above, constitute filters each having two stages of resonators, by the coupling of the resonators formed in resonator holes 21*a* and 22*a*, and 21*b* and 22*b*, respectively. Comparing FIG. 1 to FIG. 2, resonators R1 and R2 shown in FIG. 1 represent resonators formed by resonator holes 21*a* and 22*a*, respectively, of dielectric filter 1*a*, while resonators R3 and R4 represent resonators formed by resonator holes 21*b* and 22*b*, respectively, of dielectric filter 1*b*. The external coupling capacitance Ce1 between resonator R1 and transmitting terminal TX, the external coupling capacitance Ce4 between resonator R4 and receiving terminal RX, and external coupling capacitances Ce2 and Ce3 between resonators R2 and R3 and antenna terminal ANT respectively, are provided by interelectrode capacitances formed between input/output electrodes 51*a*, 52*a*, 51*b*, 52*b* and corresponding inner conductors 31*a*, 32*a*, 31*b*, and 32*b* of the dielectric filters 1*a* and 1*b*.

However, in the conventional antenna duplexer shown in FIG. 2, two dielectric filters 1*a* and 1*b* formed by two dielectric blocks 10*a* and 10*b*, as well as a coupling board 20 for connecting, fixing and mounting the filters, are necessary for forming the antenna duplexer. This conventional antenna duplexer therefore requires a large number of parts and numerous assembly steps including the soldering of these components. Thus, the conventional antenna duplexer of FIG. 2 impedes reduction in size, and increases the cost of components, the number of manufacturing steps and the cost of manufacturing.

Other known examples of a conventional antenna duplexer includes a number of dielectric resonators each having one resonator hole formed in one dielectric block, and arranged parallel to each other. In such an example, external components such as capacitor elements are necessary, in a addition to the coupling board, which results in larger number of parts.

SUMMARY OF THE INVENTION

Therefore, an object of the present invention is to provide an surface mountable antenna duplexer which is smaller in size than a conventional antenna duplexer, but comprises less parts, requires less manufacturing steps and is less costly.

Briefly stated, in the present invention, a plurality of resonator holes are formed extending from one to the other end surfaces of a dielectric block. Inner conductors are formed on inner peripheral surfaces of the resonator holes except for portions of the holes near one end surface. A pair of input/output electrodes and a common electrode are formed at portions of an outer conductor for coupling with the inner conductors. The plurality of resonators and the plurality of inner conductors form a portion serving as a transmitting filter and a portion serving as a receiving filter are formed in the dielectric block.

Therefore, according to the present invention, two dielectric filters, that is, a transmitting filter and a receiving filter, are formed in one dielectric block. Input/output electrodes and a common electrode for connection with an external circuit are formed on an outer surface of the dielectric block, and the two dielectric filters are coupled by the common electrode, so that an antenna duplexer of the present invention comprises only one dielectric block.

In an embodiment of the present invention, between the portion serving as the transmitting filter and the portion serving as the receiving filter, a through hole having an inner conductor electrically connected to an outer conductor is formed parallel to the plurality of resonator holes. By the provision of this through hole with an inner conductor, isolation between the transmitting filter and receiving filter can be improved.

In another embodiment of the present invention, the inner conductor of the through hole, which is connected to the outer conductor at its the other end, is electrically connected with the common electrode. This electrical connection between the inner conductor and the common electrode creates an inductance between the common terminal and the ground for absorbing reflected phases of the transmitting filter and the receiving filter.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 3:
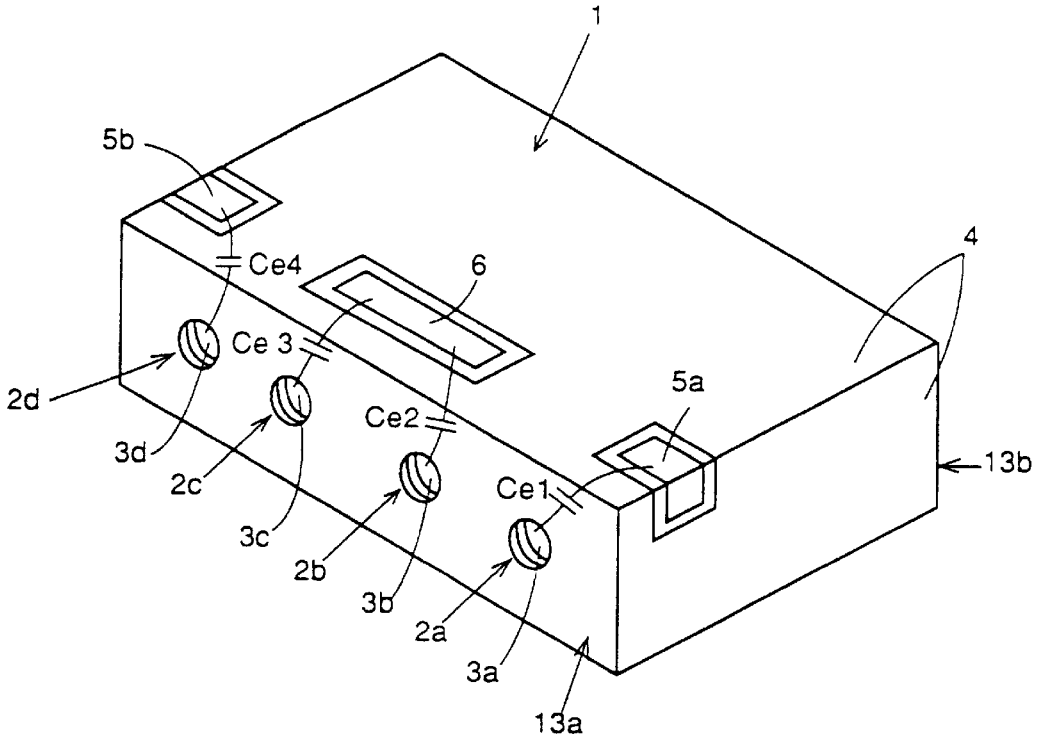
FIG. 3 is a perspective view of an embodiment of the present invention.

FIG. 3 is a perspective view of an antenna duplexer in accordance with one embodiment of the present invention. Referring to FIG. 3, the antenna duplexer of one embodiment of the present invention includes an approximately rectangular parallelopiped dielectric block 1. Four resonator holes 2*a*, 2*b*, 2*c* and 2*d* are formed extending from one to the other of a pair of opposing end surfaces of the dielectric block 1. Inner conductors 3*a*, 3*b*, 3*c* and 3*d* are formed on inner peripheral surfaces of resonators 2*a*, 2*b*, 2*c* and 2*d*, respectively. On an outer peripheral surface of dielectric block 1, an outer conductor 4 is formed except at regions where a pair of input/output electrodes 5*a* and 5*b* and one antenna electrode 6 are formed.

A pair of input/output electrodes 5*a* and 5*b* are formed extending from the surface of dielectric block 1 which will be the mounting surface onto the substrate (upper surface of FIG. 3) to one and the other side surfaces of dielectric block 1, respectively, near the open end surface 13*a*. Antenna electrode 6 is formed at the side surface of dielectric block 1 near the open end surface 13*a*, and between the input/output electrodes 5*a* and 5*b*.

Each end of inner conductors 3*a* to 3*d* is isolated i.e., not conducted from outer conductor 4, which extends slightly into each of the resonator holes 2*a* to 2*d*, since there is no portion of each inner conductor near the open end surface 13*a*. In other words, in each resonator hole 2*a* to 2*d*, a ring shaped portion of the dielectric block material near the end surface 13*a* is exposed since inner conductors 3*a* to 3*d* do not extend that far. However, the ends of inner conductors 3*a* to 3*d* are electrically conducted (short-circuited) to outer conductor 4 at the short-circuited end surface 13*b*, which is opposite to the open end surface 13*a*. Input/output electrodes 5*a*, 5*b* and antenna electrode 6 are isolated from outer conductor 41 as there is a non-conductive portion around each of these electrodes.

In the antenna duplexer structure as described above, between inner conductors 3*a* and 3*d* and input/output electrodes 5*a* and 5*b*, and between inner conductors 3*b* and 3*c* and antenna electrode 6, there are formed external coupling capacitances Ce1, Ce2, Ce3 and Ce4, as schematically shown in FIG. 3. By the coupling of two resonators corresponding to resonator holes 2*a* and 2*b*, a transmitting filter is formed. By the two resonators corresponding to resonator holes 2*c* and 2*d*, a receiving filter is formed. The transmitting filter and the receiving filter are both coupled to antenna electrode 6, and this results in an integrated antenna duplexer having three terminals for input/output (i.e., the antenna electrode 6 and the pair of input/output electrodes 5*a* and 5*b*, which corresponds to the equivalent circuit shown in FIG. 1 of the prior art.

Figure 1:
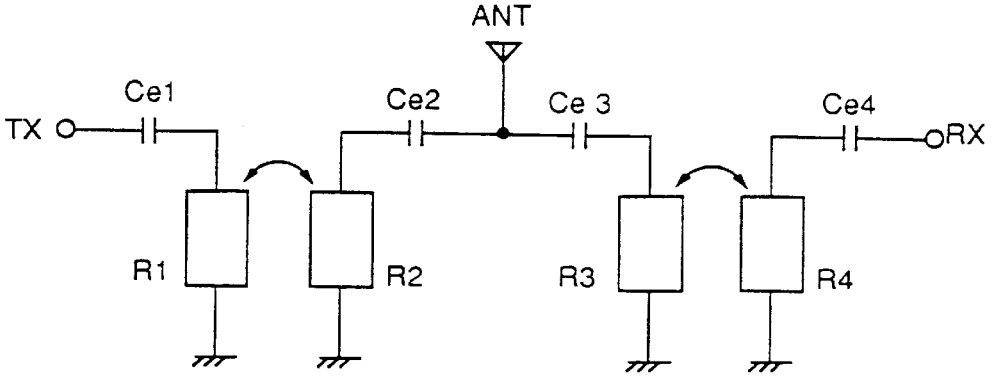
FIG. 1 PRIOR ART
FIG. 1 is an schematic circuit diagram of a conventional antenna duplexer.
Figure 2:
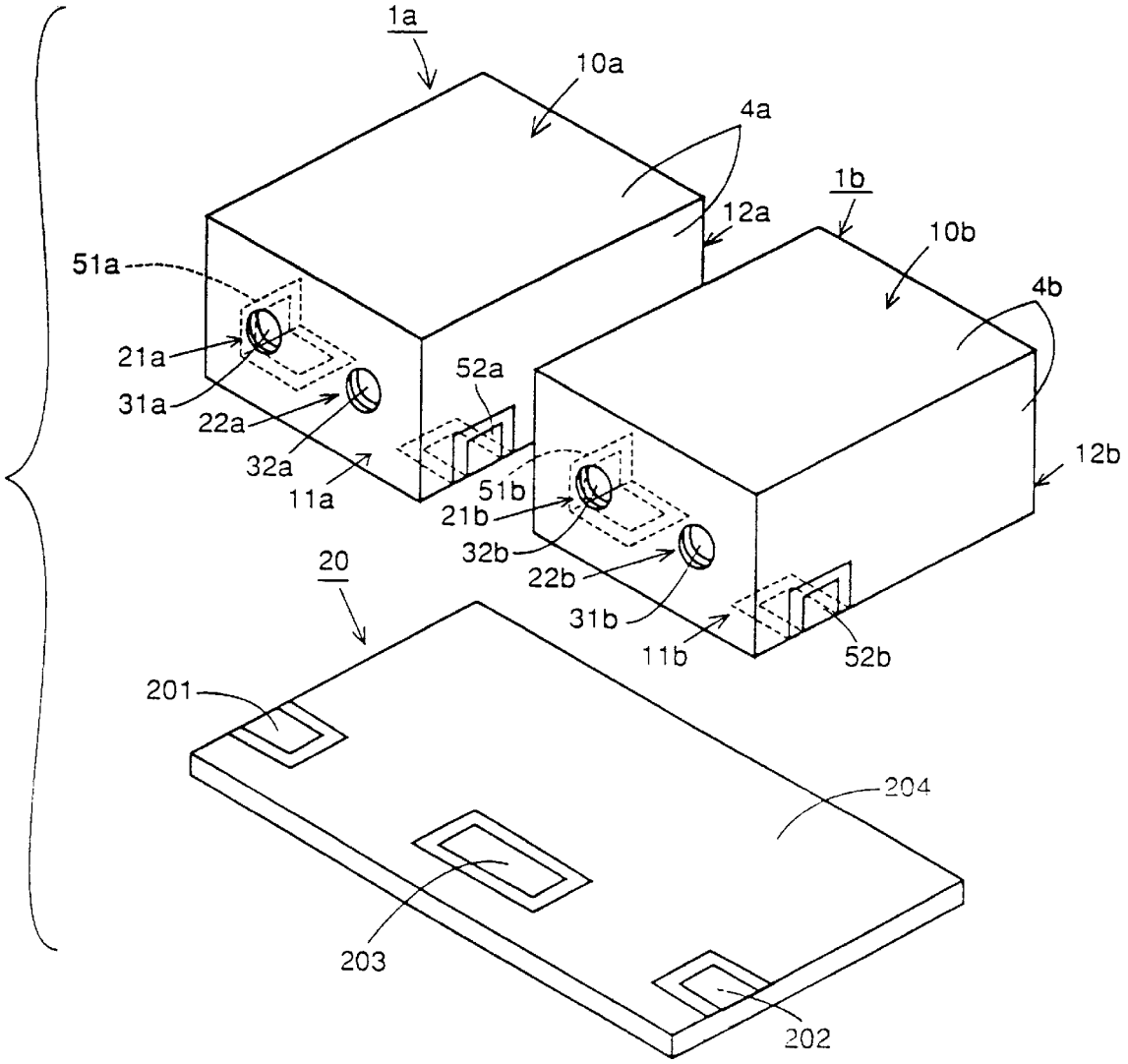
FIG. 2 PRIOR ART
FIG. 2 is a perspective view of a conventional antenna duplexer.

The resonators R1 and R2 shown in FIG. 1 correspond to the resonators formed by resonator holes 2*a* and 2*b*, respectively, and the resonators R3 and R4 correspond to the resonators formed by resonator holes 2*c* and 2*d*, respectively. The external coupling capacitances Ce1 and Ce4 between resonator R1 and transmitting terminal TX and resonator R4 and receiving terminal RX results from the interelectrode capacitances between input/output electrodes 5*a* and inner conductors 3*a*, and between input/output electrode 5*b* and inner conductor 3*d*, respectively. External coupling capacitances Ce2 and Ce3 between resonators R2 and R3 and antenna terminal ANT results from the interelectrode capacitances between the antenna electrode 6 and inner conductor 3*b*, and antenna electrode 6 and inner conductor 3*c*, respectively.

When the antenna duplexer is to be mounted on a substrate, the surface on which input/output electrodes 5*a* and 5*b* and antenna electrode 6 are formed (upper surface of FIG. 3) serves as the bottom surface which is mounted on the substrate.

As described above, according to one embodiment of the present invention, an antenna duplexer is formed in one dielectric block since transmitting and receiving dielectric filters are formed in the one dielectric block, input/output electrodes 5*a* and 5*b* and an antenna electrode 6, for connection to an external circuit, are formed on an outer surface of the one dielectric block 1, and the two filters are coupled by the antenna electrode. Therefore, the number of components can be reduced, the number of manufacturing steps can be decreased, and the cost can be reduced.

Figure 4:
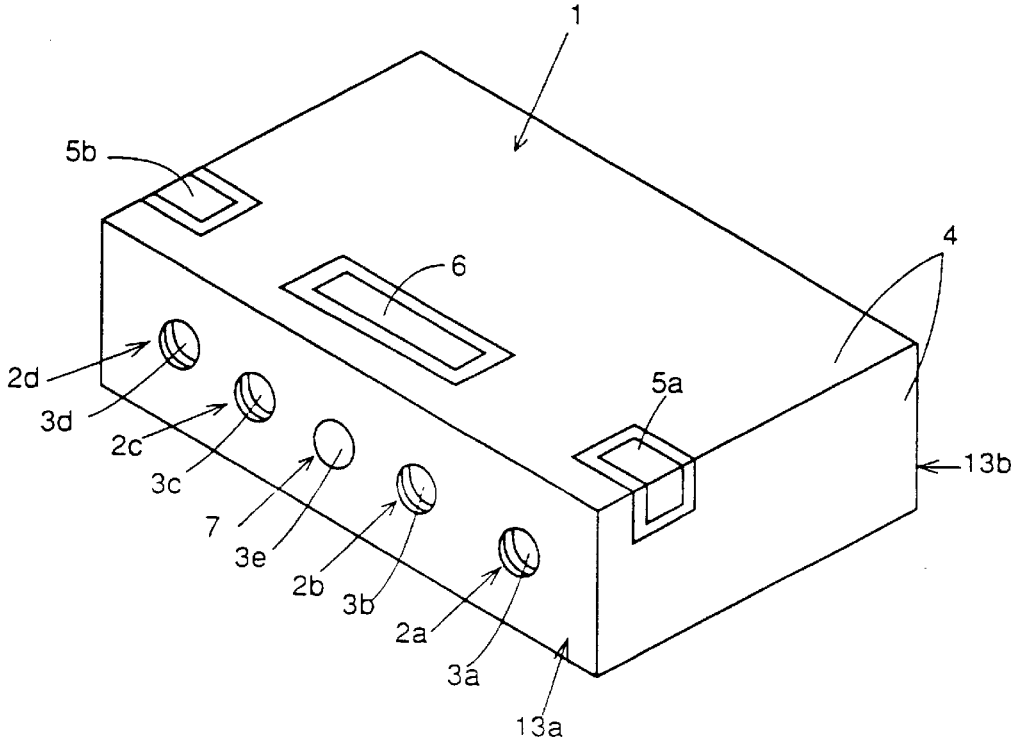
FIG. 4 is a perspective view of another embodiment of the present invention.

FIG. 4 is a perspective view showing a second embodiment of the present invention. The embodiment shown in FIG. 4 includes a through hole 7 formed between the transmitting and receiving filters of the antenna duplexer of the embodiment shown in FIG. 3, that is, between resonator holes 2*b* and 2*c*, parallel to the holes 2*b* and 2*c*. An inner conductor 3*e* is formed on the inner peripheral surface of through hole 7, and the inner conductor 3*e* is electrically conducted (short-circuited) with the outer conductor 4 at both end surfaces, that is, the open end surface 13*a* and the short-circuited end surface 13*b*. Other elements of the antenna duplexer of FIG. 4 are the same as those of corresponding elements in FIG. 3 and will not be described herein.

In the embodiment shown in FIG. 4, the inner conductor 3*e* of the through hole 7 which is electrically connected to outer conductor 4 shields, the transmitting filter and the receiving filter, and therefore isolation between the filters can be improved.

Figure 5:
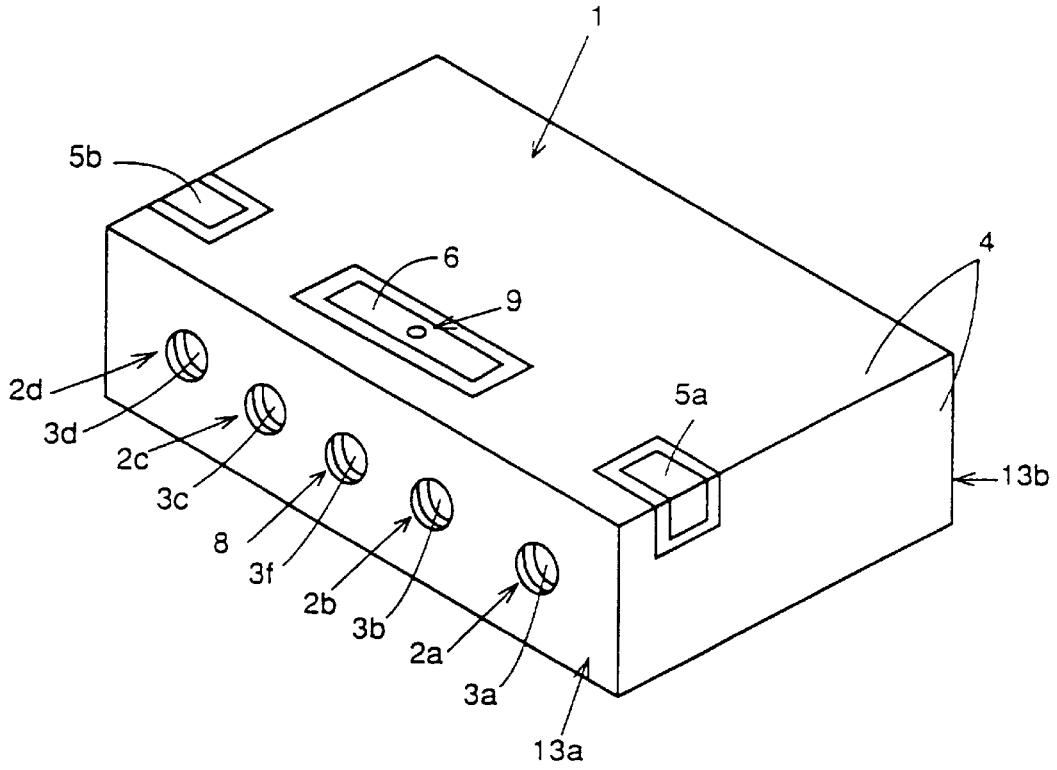
FIG. 5 is a perspective view of a still another embodiment of the present invention.
Figure 6:
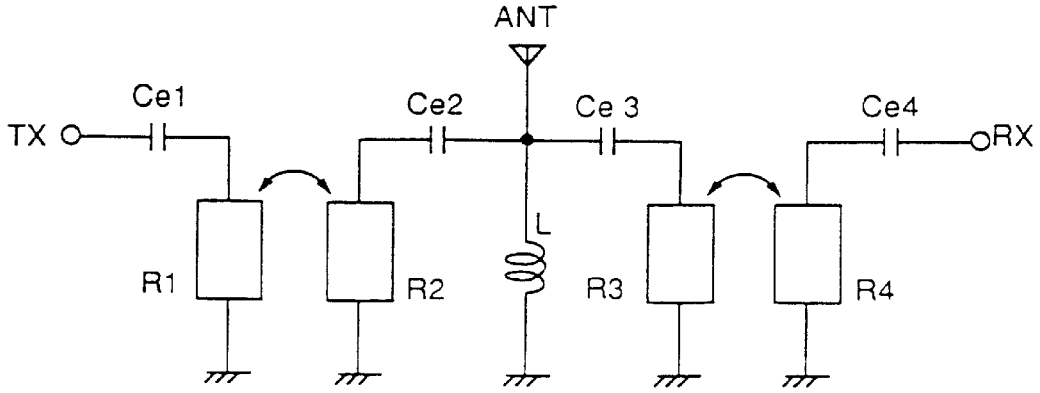
FIG. 6 is an schematic circuit diagram of the embodiment shown in FIG. 5.

FIG. 5 is a perspective view showing a third embodiment of the present invention, and FIG. 6 is an equivalent circuit diagram of the embodiment shown in FIG. 5. In this embodiment shown in FIG. 5, a through hole 8 is formed between the transmitting filter and the receiving filter of the antenna duplexer shown in FIG. 3, that is, between resonators 2*b* and 2*c*, and parallel to the resonators 2*b* and 2*c*. An inner conductor 3*f* is formed on the inner peripheral surface of the through hole 8, and a through hole 9 is further provided which connects (conducts) inner conductor 3*f* to antenna electrode 6. In the similar manner as conductors 3*a*, 3*b*, 3*c* and 3*d* of resonator holes 2*a*, 2*b*, 2*c* and 2*d*, one end of inner conductor 3*f* formed on the inner peripheral surface of through hole 8 is isolated from outer conductor 4 as there is no portion of inner conductor 3*f* near the open end surface 13*a*, while it is electrically connected with outer conductor 4 at the short-circuited end surface 13*b*. Other elements of the antenna duplexer of FIG. 5 are the same as those of corresponding elements in FIG. 3.

In the antenna duplexer shown in FIG. 5, there is an inductance L, such as shown in FIG. 6, between antenna electrode 6 and outer conductor 4, because of the inner conductor 3*f* of the through hole 8 being connected to antenna electrode 6 by means of through hole 9. The inductance L is capable of absorbing or annulling reflected phase or susceptance of the transmitting filter and the receiving filter between the antenna terminal ANT and the ground. The other elements in FIG. 6 correspond to those described above in connection with FIG. 1, and will not be described herein.

As described above, in the antenna duplexer of each of the embodiments, the transmitting filter and the receiving filter are provided by one dielectric block 1, and input/output electrodes 5*a* and 5*b* and antenna electrode 6 for connection to an outer circuits are formed on an outer surface of dielectric block 1. Therefore a component such as coupling board used in the conventional antenna duplexer becomes unnecessary in the present invention.

By providing a through hole having an inner conductor formed between the transmitting and receiving filters as in the second and third embodiments, isolation between the transmitting and receiving filters can be improved. Further, an antenna duplexer having an inductance for absorbing reflected phase of the transmitting and receiving filters inserted between antenna terminal ANT and ground can be provided in one dielectric block.

The shape, location and the like of the input/output electrodes 5*a*, 5*b* and antenna electrode 6 of respective embodiments are not limited to those disclosed, and the shape, dimension, positions may be arbitrarily changed so as to change the capacitance values, and to provide predetermined filter characteristics. Isolation between the outer conductor and the inner conductor on the side of the open end surface 13*a* is implemented by not extending the inner conductor to the open end surface 13*a* in the embodiments described above. However, it is not limited to this, and a non-conducting portion may be provided on the open end surface 13*a*. Namely, one end in the axial direction of the inner conductor may reach the open end surface 13*a*. Alternatively, the outer conductor may not be provided at all on the open end surface 13*a*.

Though a resonator hole has a constant diameter in the embodiments above, the diameter of the resonator hole may be changed midway, and a coupling groove for changing the degree of coupling between each of the resonators may be provided at the top and bottom surfaces of dielectric block 1, or a coupling hole for changing the degree of coupling between each of the resonators may be provided between the resonators.

Though an antenna duplexer including a transmitting filter consisting of two stages of resonators and a receiving filter consisting of two stages of resonators has been described in the embodiments above, each filter may be constituted by three or more stages of resonators including three or more resonator holes.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An antenna duplexer, comprising:

a dielectric block having a pair of opposing end surfaces and an outer peripheral surface which extends between said opposing end surfaces;

a plurality of resonator holes extending from one of said end surfaces to the other of said end surfaces of said dielectric block, each hole having a respective inner surface;

an outer conductor disposed on said outer peripheral surface of said dielectric block;

each resonator hole having a respective inner conductor disposed in the corresponding resonator hole; and a common electrode and a pair of input/output electrodes disposed on said outer peripheral surface of said dielectric block, and not on said opposing end surfaces of said dielectric block, said outer peripheral surface of said dielectric block being substantially completely covered by said outer conductor except for non-conductive portions surrounding said common electrode and each of said input/output electrodes;

said plurality of resonator holes defining first and second groups of resonator holes in said dielectric block, said first group of resonator holes serving as a transmitting filter and said second group of resonator holes serving as a receiving filter, said resonator holes in said first group being separate and distinct from said resonator holes in said second group;

a respective one of said input/output electrodes being coupled to one of said resonator holes in a corresponding one of said first and second groups, and said common electrode being coupled to another one of said resonator holes in each of said first and second groups, for permitting said common electrode to conduct signals to and from both said transmitting filter and said receiving filter;

a through hole extending between said opposing end surfaces, said through hole being located in said dielectric block substantially between said first and second groups of resonator holes;

said outer conductor being disposed on both of said opposing end surfaces of said dielectric block; and said through hole having an inner conductor extending continuously through said through hole and being conductively connected to said outer conductor at both of said opposing end surfaces.

2. The antenna duplexer according to claim 1, wherein:

each said inner conductor in said each resonator hole comprises a respective pair of inner conductor portions;

in each said resonator hole, a respective nonconductive portion is disposed between said inner conductor portions and forms a corresponding capacitance between said corresponding pair of inner conductor portions: and each said inner conductor portion is conductively connected to said outer conductor at a respective one of said end surfaces of the dielectric block.

3. The antenna duplexer according to claim 1, wherein said common electrode serves as an antenna electrode.

4. The antenna duplexer according to claim 1, wherein:

in each said resonator hole, said respective inner conductor is electrically connected to said outer conductor at said at least one of said opposing end surfaces and not at the other end surface.

5. The antenna duplexer according to claim 2, wherein each said respective inner surface of said plurality of resonator holes has a substantially constant cross-sectional shape along an axial direction of the corresponding hole.

6. The antenna duplexer according to claim 5, wherein a surface of each said respective non-conductive portion is substantially flush with said inner surface of the corresponding hole.

7. The antenna duplexer according to claim 2, wherein a surface of each said respective non-conductive portion is substantially flush with said inner surface of the corresponding hole.

8. The antenna duplexer according to claim 1, wherein each said inner conductor in said each resonator hole is conductively connected to said outer conductor at both of said opposing end surfaces of said dielectric block.

9. The antenna duplexer according to claim 8, wherein:

each said inner conductor in said each resonator hole comprises a respective pair of inner conductor portions;

in each said resonator hole, a respective non-conductive portion is disposed between said pair of inner conductor portions and forms a corresponding capacitance between said corresponding pair of inner conductor portions.

10. The antenna duplexer according to claim 1, wherein said outer peripheral surface comprises a plurality of sides each extending between said two opposing end surfaces, and each of said input/output electrodes extends between a respective pair of said sides which are adjacent to each other.

11. The antenna duplexer according to claim 10, wherein said plurality of sides includes a mounting side, said mounting side being substantially flat, said common electrode being disposed on said mounting side, and each of said input/output electrodes extends respectively from said mounting side to a corresponding additional side, each said additional side being adjacent to said mounting side.

* * * * *